US009393675B2

(12) United States Patent
Beauregard

(10) Patent No.: US 9,393,675 B2
(45) Date of Patent: Jul. 19, 2016

(54) BAR CLAMP AND BAR CLAMP ASSEMBLY

(71) Applicant: Damstom Inc., Terrebonne (CA)

(72) Inventor: Georges Beauregard, Chertsey (CA)

(73) Assignee: DAMSTOM INC., Terrebonne (CA)

( * ) Notice: Subject to any disclaimer, the term of this patent is extended or adjusted under 35 U.S.C. 154(b) by 5 days.

(21) Appl. No.: 14/416,908

(22) PCT Filed: Jul. 26, 2013

(86) PCT No.: PCT/CA2013/050585
§ 371 (c)(1),
(2) Date: Jan. 23, 2015

(87) PCT Pub. No.: WO2014/015441
PCT Pub. Date: Jan. 30, 2014

(65) Prior Publication Data

US 2015/0174738 A1 Jun. 25, 2015

Related U.S. Application Data

(60) Provisional application No. 61/676,003, filed on Jul. 26, 2012.

(51) Int. Cl.

| | |
|---|---|
| ***B25B 1/02*** | (2006.01) |
| ***B25B 5/10*** | (2006.01) |
| ***B25B 1/10*** | (2006.01) |
| ***B25B 5/14*** | (2006.01) |
| ***B25B 5/16*** | (2006.01) |

(52) U.S. Cl.
CPC ..... *B25B 5/102* (2013.01); *B25B 1/103* (2013.01); *B25B 5/10* (2013.01); *B25B 5/103* (2013.01); *B25B 5/145* (2013.01); *B25B 5/163* (2013.01)

(58) Field of Classification Search
CPC ..... B25B 5/00; B25B 5/10; B25B 5/145; B25B 5/103; B25B 5/163; B25B 5/102
See application file for complete search history.

(56) References Cited

U.S. PATENT DOCUMENTS 5,467,972 A * 11/1995 Lee ..... B25B 5/145 269/118
7,909,315 B2 * 3/2011 Hill ..... B25B 5/145 269/104

FOREIGN PATENT DOCUMENTS

| | | | |
|---|---|---|---|
| CA | 22552774 | A1 | 2/2000 |
| DE | 202010010687 | U1 | 7/2010 |
| GB | 2192146 | A | 1/1988 |

OTHER PUBLICATIONS

International Search Report and Written Opinion for corresponding International Application No. PCT/CA2013/050585 mailed on Oct. 15, 2013 (5 pages).

*Primary Examiner* — Monica Carter
*Assistant Examiner* — Nirvana Deonauth
(74) *Attorney, Agent, or Firm* — Bookoff McAndrews, PLLC

(57) ABSTRACT

A bar clamp configured for engagement with a workpiece is provided. The bar clamp includes a pair of parallel elongated bars, each extending along a longitudinal axis. The bar clamp also includes a fixed connector and a movable connector extending along a transverse axis perpendicular to the longitudinal axis for connecting the elongated bars together and maintaining a transverse separation therebetween. The bar clamp further includes an adjustment mechanism for adjusting a transverse separation between the elongated bars and for compressing the workpiece along the transverse axis, a positioning mechanism for adjusting a position of the movable connector along the longitudinal axes of the elongated bars, and a longitudinal compression mechanism connected to the fixed connector for compressing the workpiece along the longitudinal axis. A bar clamp assembly for engagement with a workpiece and including a plurality of spaced-apart bar clamps configured for receiving therebetween the workpiece is also provided.

8 Claims, 6 Drawing Sheets

BAR CLAMP AND BAR CLAMP ASSEMBLY

CROSS-REFERENCE TO RELATED APPLICATIONS

This application is a National Stage filing under 35 U.S.C. §371 of International Application No. PCT/CA2013/050585, filed Jul. 26, 2013, which claims priority to U.S. Provisional Application No. 61/676,003, filed Jul. 26, 2012, the contents of each of which are incorporated herein by reference in their entireties.

FIELD OF THE INVENTION

The present invention relates to the field of clamping devices for woodworking applications and the like, and more particularly concerns a bar clamp and bar clamp assembly, suitable for use in joining together wood parts or other parts.

BACKGROUND OF THE INVENTION

In the art of woodworking, various devices or tools may be used to join, connect or otherwise hold together wood parts for assembly thereof, such as by gluing or the like. Examples of such devices include, without being limited to, vises, bar clamps, pipe clamps, C-clamps, and several other types of clamps. Among these different varieties of clamps, bar clamps and pipe clamps, hereinafter collectively referred to as bar clamps, are common clamps for edge-gluing of wood parts to produce workpieces such as laminated wooden panels used, for example, in furniture or cabinet construction. Bar clamps can also be employed for joining together other materials such as plastics or metal parts. Depending on the intended application, bar clamps may be used to hold wood parts together, parallelly or perpendicularly to one another, at various stages of the assembly process such as, for example, before and after gluing, and before securing fasteners.

Conventional bar clamps generally include a movable member (e.g. a slide jaw) and a fixed member (e.g. a fixed jaw), between which may be disposed wood parts to be glued, joined or otherwise held together. The movable member may be configured to move or slide along a length of the bar while the fixed member may be provided with an adjusting handle (e.g. an adjusting screw) for applying pressure to the wood parts. In a typical use of bar clamps, the movable member is moved until it is separated from the fixed member by a distance that is slightly wider than the total width of the wooden components to be clamped. The bar clamp is then tightened by turning the adjusting screw, which results in a compressive force being imposed on the wood parts. In turn, this ensures that the wood parts are properly aligned and joined while being glued or otherwise fastened together.

While existing bar clamps may be suitable for some applications, there remain several drawbacks associated therewith. More specifically, a general issue with conventional bar clamps is that they generate compressive forces that are strictly longitudinal, that is, oriented along the length of the bar clamps. In other words, as clamping forces are applied lengthwise between the movable member and the fixed member, conventional bar clamps are often restricted to generating one-dimensional clamping forces only.

As a result, when, for example, narrow pieces of wood are edge-glued together in order to form a wider laminated wooden panel, the compressive clamping force applied to the wood pieces by the bar clamp remains in the plane of the resulting wooden panel. In other words, no compressive or maintaining force is imposed perpendicularly to the plane of the laminated wooden panel, that is, across its thickness. This may be problematic in circumstances where applying compressive forces in more than one direction with respect to the components to be joined together by the bar clamp is desirable. These circumstances may arise, for example, when one wishes to form a multilayered panel, stabilize and hold steady pieces to be joined, or reduce deformations that may occur during the drying process of the adhesives used to join wood pieces. In such cases, existing bar clamps cannot be used alone and other specialized clamping devices need to be provided. These specialized clamping devices may be cumbersome to use and expensive to purchase. Moreover, installing, adjusting and tightening each of these additional clamping tools add lengthy steps to the overall process of fabricating a complete workpiece.

Another drawback associated with existing bar clamps is that the range of possible thicknesses for the final workpiece is limited by the size of the adjusting handle and that of the throat of the bar clamp. As a result, several different bar clamps must be purchased in order to fabricate workpieces of different thicknesses, thereby incurring additional costs. Moreover, existing bar clamps are typically not well suited for joining materials thicker than about 2½ inches.

In light of the above, a need exists in the art for a bar clamp and a bar clamp assembly capable of imposing compressive forces to a workpiece along more than one dimension thereof, while also possibly alleviating at least some of the drawbacks of the prior art.

SUMMARY OF THE INVENTION

An object of the present invention is to satisfy at least one of the above-mentioned needs.

In accordance with an aspect of the present invention, there is provided a bar clamp configured for engagement with a workpiece. The bar clamp comprises:

- a pair of parallel elongated bars, each elongated bar extending along a longitudinal axis between a first and a second end thereof;
- a fixed connector and a movable connector for connecting the pair of elongated bars together, each of the fixed and movable connectors extending between the elongated bars along a transverse axis perpendicular to the longitudinal axes of the elongated bars, and maintaining a transverse separation between the elongated bars;
- an adjustment mechanism for adjusting the transverse separation between the elongated bars and compressing the workpiece along the transverse axis;
- a positioning mechanism for adjusting a position of the movable connector along the longitudinal axes of the elongated bars; and
- a longitudinal compression mechanism connected to the fixed connector and operable to compress the workpiece along the longitudinal axes of the elongated bars.

In accordance with another aspect of the present invention, there is provided a bar clamp assembly for engagement with a workpiece. The bar clamp assembly comprises a plurality of spaced-apart bar clamps configured for receiving therebetween the workpiece. Each of the plurality of bar clamps comprises:

- a pair of parallel elongated bars, each elongated bar extending along a longitudinal axis between a first and a second end thereof;
- a fixed connector and a movable connector for connecting the pair of elongated bars together, each of the fixed and movable connectors extending between the elongated bars along a transverse axis perpendicular to the longitudinal axes of the elongated bars, and maintaining a transverse separation between the elongated bars;

an adjustment mechanism for adjusting the transverse separation between the elongated bars and compressing the workpiece along the transverse axis;

a positioning mechanism for adjusting a position of the movable connector along the longitudinal axes of the elongated bars; and a longitudinal compression mechanism connected to the fixed connector and operable to compress the workpiece along the longitudinal axes of the elongated bars.

Advantageously, some embodiments of the present invention provide bar clamps and bar clamp assemblies capable of imposing compressive forces to a workpiece along two perpendicular axes simultaneously, that is, in a single operation and with a single device. As a result of this versatility, some embodiments of the present invention can help reduce the number of clamping devices to be purchased and the number of steps to be performed in order to realize a particular woodworking project, thus saving costs and time.

Also advantageously, some embodiments of the present invention enable joining together components over a wider range of thicknesses than existing bar clamps.

Further advantageously, some embodiments of the present invention may require no welding of any kind.

Other features and advantages of the present invention will be better understood upon reading of preferred embodiments thereof, provided merely by way of non-limitative examples, and upon referring to the appended drawings.

Figure 1:
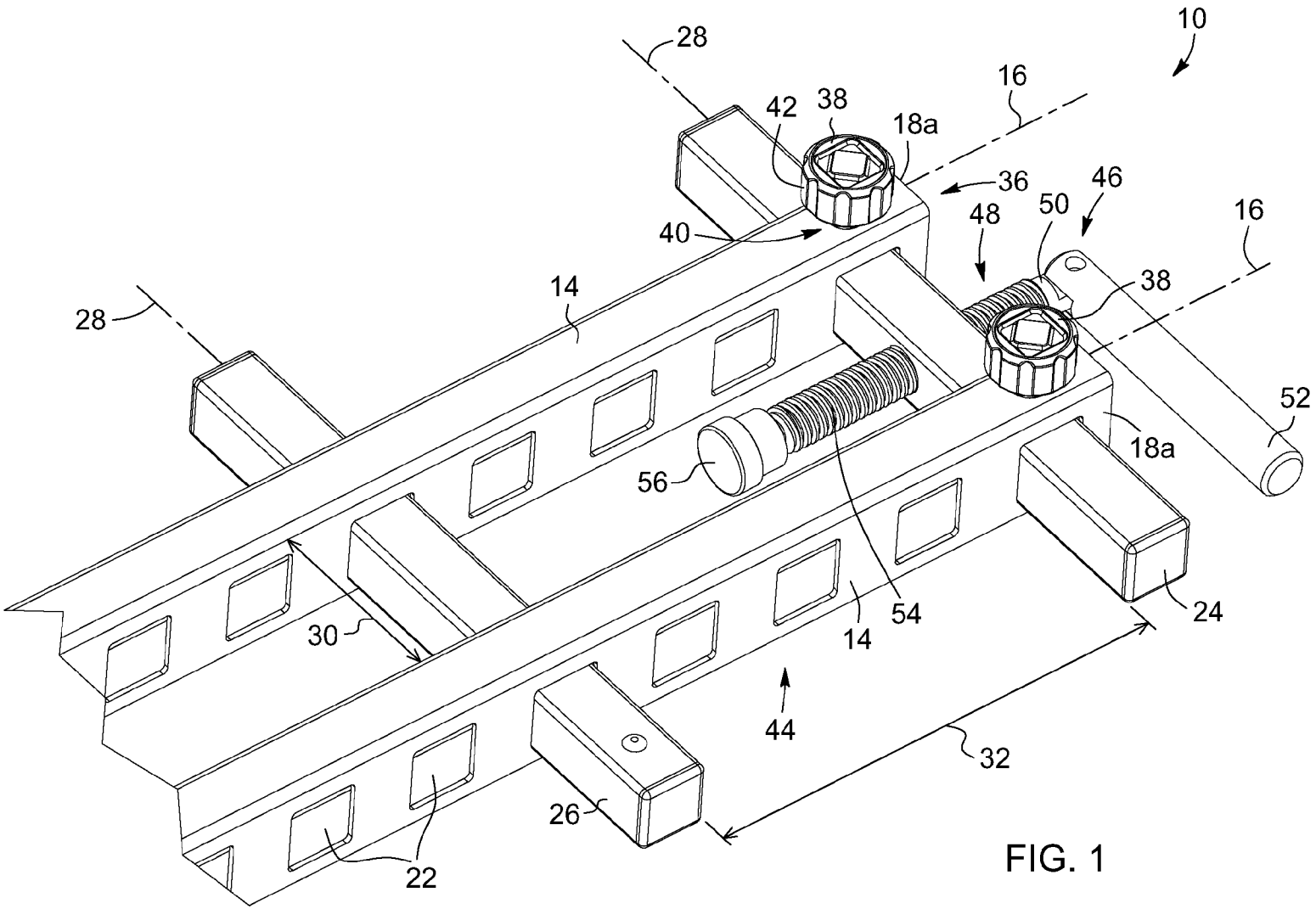
FIG. 1 is a perspective side view of a bar clamp according to an embodiment of the present invention.

While the invention will be described in conjunction with exemplary embodiments, it will be understood that it is not intended to limit the scope of the invention to such embodiments. On the contrary, it is intended to cover all alternatives, modifications and equivalents, as may be included in the present description.

DETAILED DESCRIPTION OF PREFERRED EMBODIMENTS

In the following description, similar features in the drawings have been given similar reference numerals, and, in order to not unduly encumber the figures, some elements may not be indicated on some figures if they were already identified in a preceding figure. It should also be understood herein that the elements of the drawings are not necessarily depicted to scale, since emphasis is placed upon clearly illustrating the elements and structures of the present embodiments.

In accordance with an aspect of the present invention, there is provided a bar clamp configured for engagement with a workpiece. The workpiece may include wood parts to be joined or glued together via compressive forces imposed thereon by embodiment of the bar clamp. The workpiece may form or be part of various wooden structures including, without being limited to, furniture, cabinets, stair components, door parts, moldings, shelves, laminate flooring, and the like. Of course, it will be appreciated that embodiments of the invention are not limited to woodworking applications, but could be used in many other contexts wherein a bar clamp or bar clamp assembly capable of providing compressive forces along more than one direction to a workpiece may be desirable, for example, for joining together plastics or metal parts.

Figure 2A:
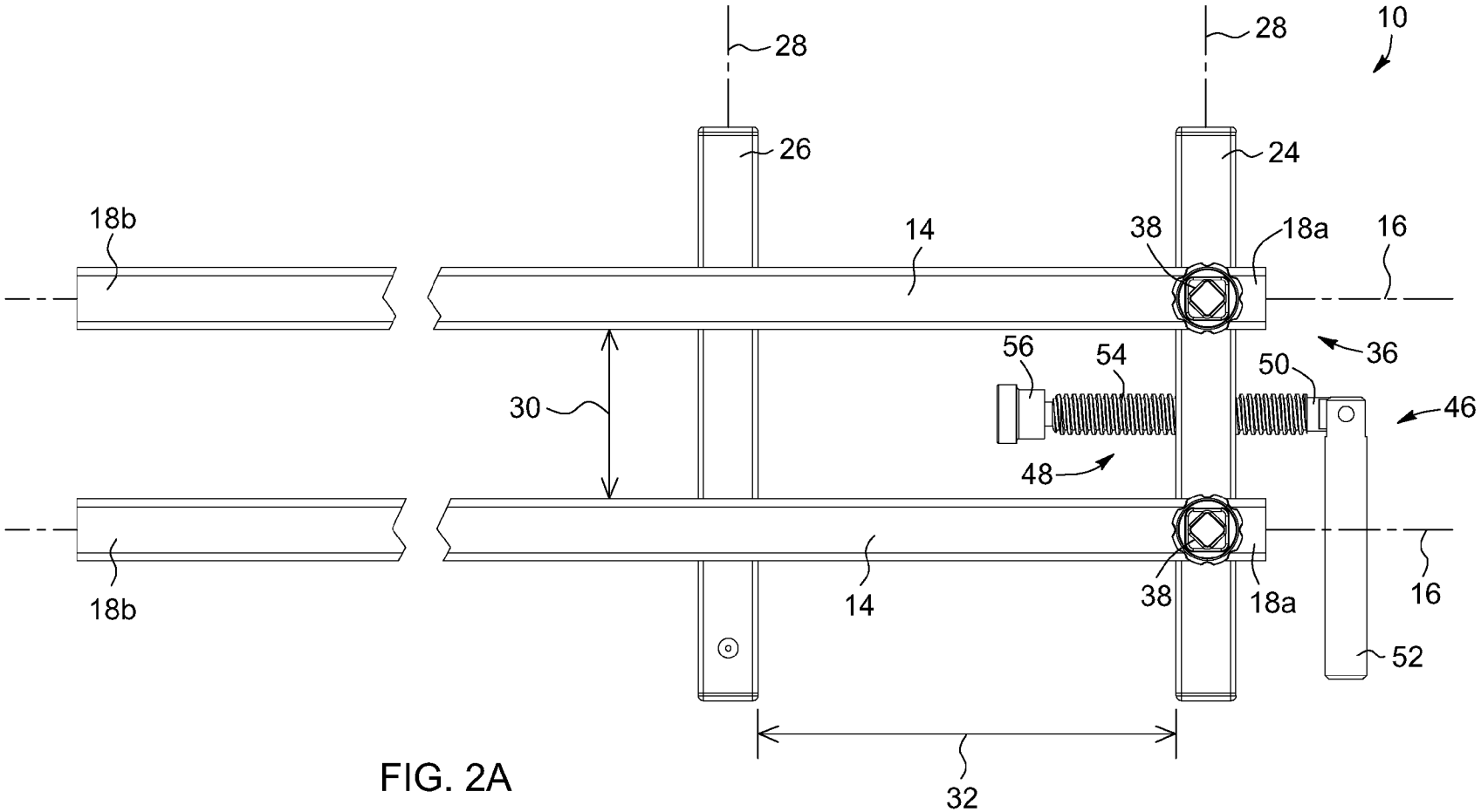
FIGS. 2A and 2B are a side elevation view and a top plan view, respectively, of the bar clamp of FIG. 1.
Figure 2B:
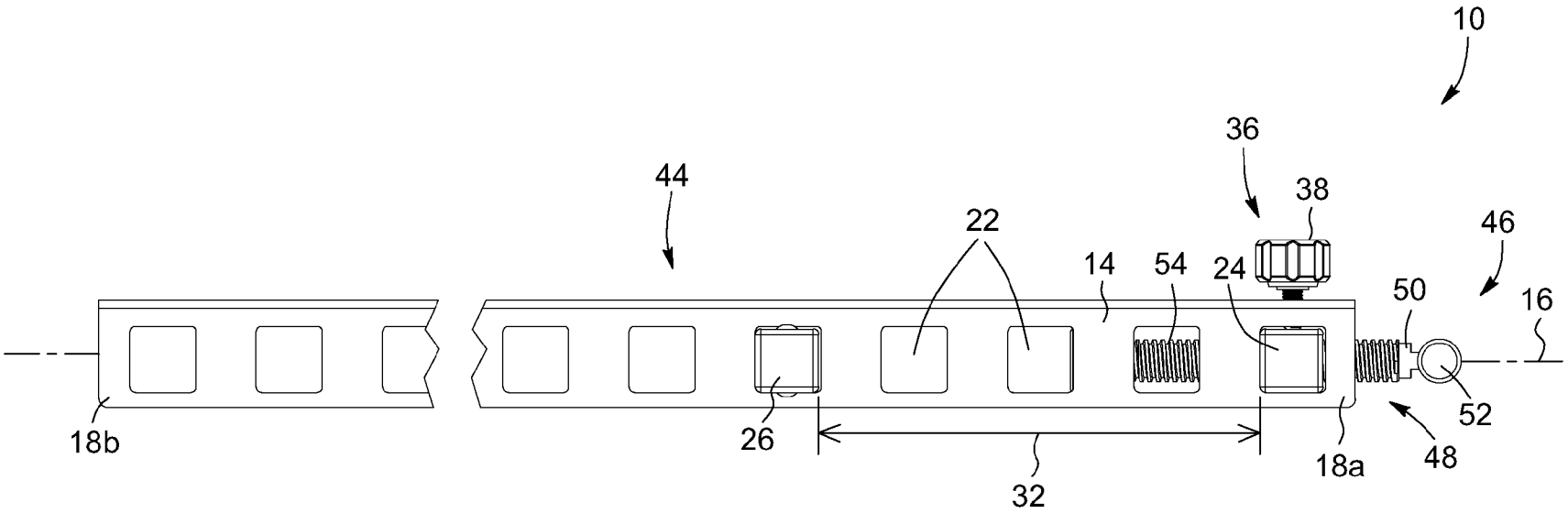

Referring to FIG. 1, there is shown a perspective side view of a bar clamp 10 according to an embodiment. FIGS. 2A and 2B respectively depict side elevation and top plan views of the bar clamp 10 of FIG. 1. The bar clamp 10 is configured for engagement with a workpiece 12, such as that depicted in FIGS. 3 and 4.

The bar clamp 10 of FIGS. 1 to 2B first includes a pair of parallel elongated bars 14, each elongated bar 14 extending along a longitudinal axis 16 between a first and a second end 18*a*, 18*b* thereof. The elongated bars 14 are preferably composed of lightweight and strong material such as, for example, aluminum, steel, stainless steel, titanium, plastic or like material. Of course, other materials may be used without departing from the scope of the invention. The elongated bars 14 may further be zinc plated, chrome plated, painted, black oxide coated, polymer powder coated or a combination thereof for protection against rust, oxidation, corrosion and the like.

Figure 3:
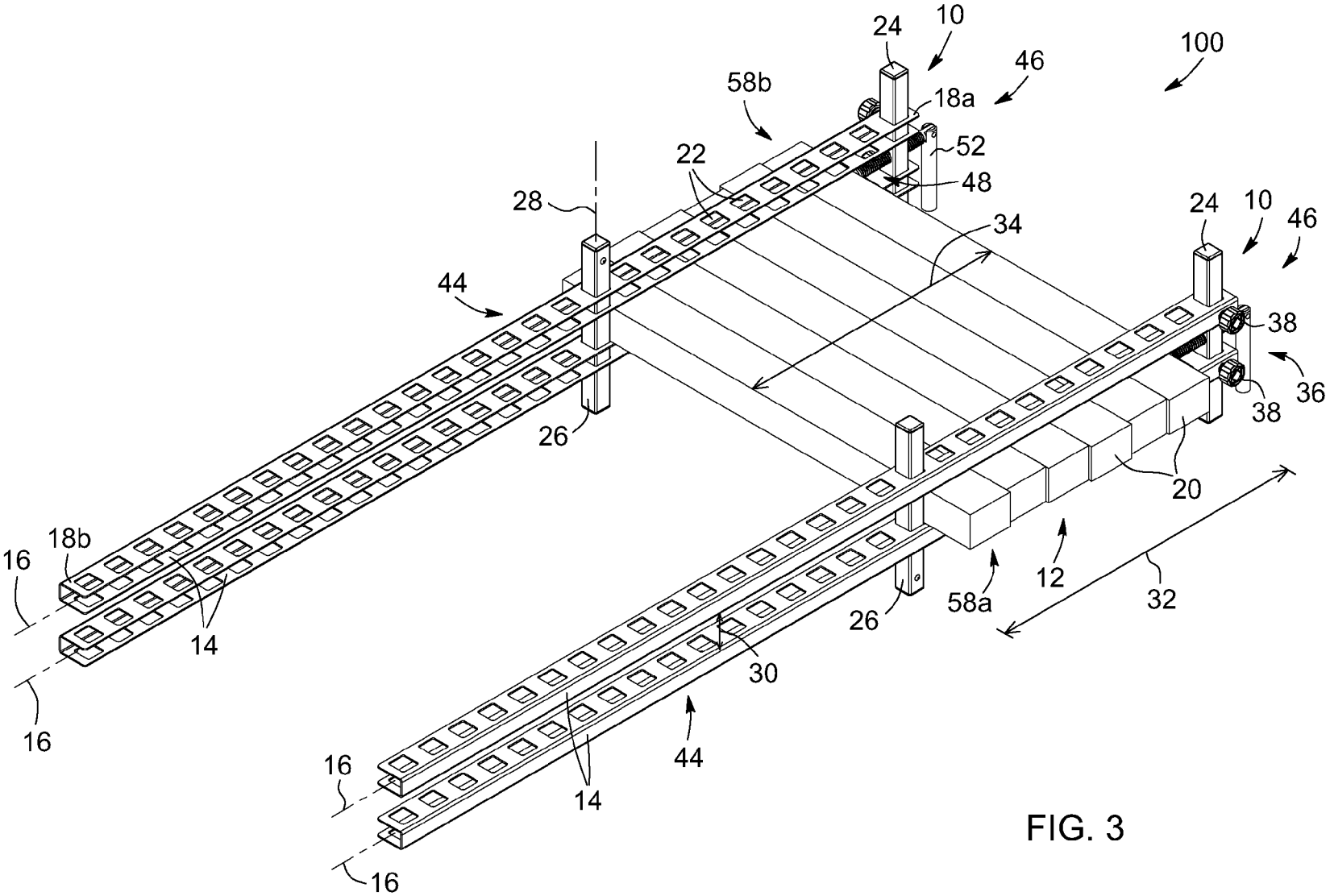
FIG. 3 is a perspective side view of a bar clamp assembly according to an embodiment of the invention.
Figure 4:
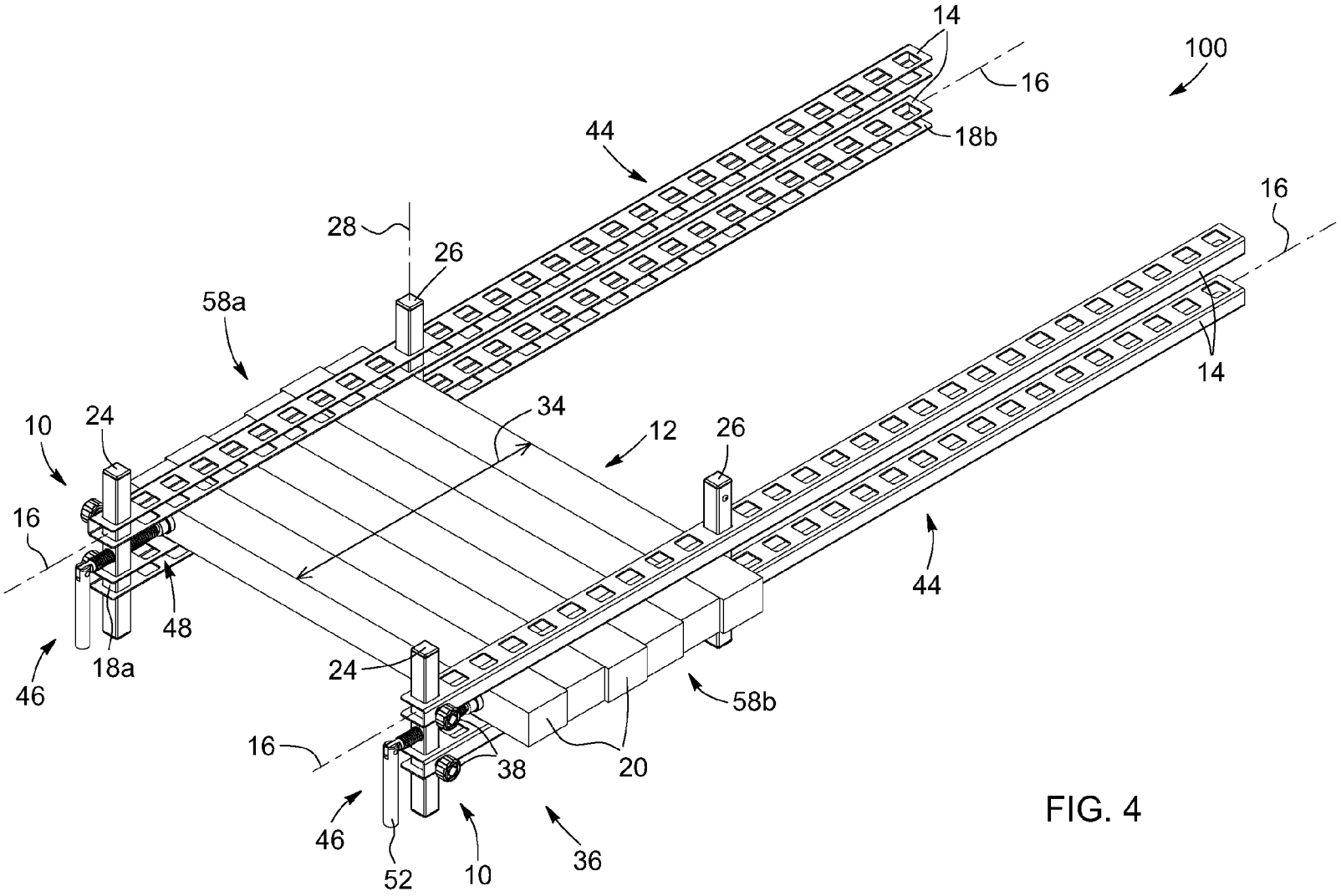
FIG. 4 is another perspective side view of the bar clamp assembly of FIG. 3

In some embodiments, the elongated bars 14 may additionally or alternatively be coated with a surface finish material that leaves no or few residues on the workpiece 12, especially when the workpiece 12 includes edge-glued wood parts 20, such as is illustrated in FIGS. 3 and 4.

In the embodiment shown in FIG. 1, each elongated bar 14 has a length of 42 inches and a 0.778-inch by 1.279-inch U-shaped cross section. Of course, it will be understood that in other embodiments, the elongated bars 14 need not be identical and may each assume various other geometrical dimensions and cross-sectional shapes without departing from the scope of the invention. For example, in some embodiments, the cross section of the elongated bars 14 may have dimensions of about 0.25 to 1 inch by about 1.25 to 2 inches.

In some embodiments, and as will be discussed in greater detail below, each elongated bar 14 may include a plurality of spaced-apart transverse holes 22 defined therein and arranged along its respective longitudinal axis 16. For example, in the embodiment of FIG. 2B, each transverse hole 22 of each elongated bar 14 passes through the two vertical sides of the U-shaped cross-section of that elongated bar 14. More specifically, in FIG. 2B, each elongated bar 14 includes twenty-eight 0.7820-inch by 0.7820-inch square holes, adjacent holes being separated from one another by a distance of 0.7180 inch. However, one of ordinary skill in the art will understand that depending on the intended applications of the bar clamp 10, the number, size, shape, separation and configuration of the transverse holes 22 may be varied without departing from the scope of the present invention.

Referring back to FIGS. 1 to 2B, the bar clamp 10 also includes a fixed connector 24 and a movable connector 26 for connecting the pair of elongated bars 14 together. Each of the fixed and movable connectors 24 and 26 extends between the elongated bars 14 along a transverse axis 28 which is perpendicular to the longitudinal axis 16 of each elongated bar 14, and maintains a transverse separation 30 between the elongated bars 14.

In the embodiment of FIGS. 1 to 2B, the fixed and movable connectors 24 and 26 are respectively embodied by a fixed and movable side bar or rod. Each of the fixed and movable side bars has a first end configured for slidable insertion into one of the plurality of spaced-apart transverse holes 22 of one of the elongated bars 14 and a second end configured for slidable insertion into one of the plurality of spaced-apart transverse holes 22 of the other one of the elongated bars 14, thereby connecting the pair of elongated bars 14 together. However, it will be apparent to one of ordinary skill in the art that other types of connectors may be used to connect the elongated bars 14. Furthermore, as for the elongated bars 14, the side bars embodying the fixed and movable connectors 24 and 26 may be composed of lightweight and strong material such as, for example, aluminum, steel, stainless steel, titanium, plastic or like material, and may also be zinc plated, chrome plated, painted, black oxide coated, polymer powder coated, or a combination thereof for protection against rust, oxidation, corrosion.

Still referring to FIGS. 1 to 2B, it will be understood that the cross-sectional shape of the fixed and movable connectors 24 and 26 is preferably selected so as to correspond substantially to that of the longitudinally spaced-apart transverse holes 22 defined in the elongated bars 14. It will also be understood that the size of the cross-section of the fixed and movable connectors 24 and 26 is preferably selected so as to be only slightly smaller than the cross-section of the transverse holes 22 and to provide a tight fit when the fixed and movable connectors 24 and 26 are inserted into the transverse holes 22. For example, in the illustrated embodiment, each of the fixed and movable connectors 24 and 26 is a side bar having a 0.75-inch by 0.75-inch square cross section.

Preferably, the fixed connector 24 is inserted into one of the transverse holes 22 located near the first or second end 18*a*, 18*b* of each elongated bar 14, for example the first or last transverse hole 22 of each elongated bar 14, as shown in FIGS. 1 to 2B. Likewise, the movable connector 26 is preferably inserted into one of the transverse holes 22 of each elongated bar 14 such that a longitudinal separation 32 between the fixed connector 24 and the movable connector 26 is slightly larger than a width 34 of the workpiece 12 to be engaged into the bar clamp 10, as illustrated in FIG. 4.

Referring now to FIGS. 1 to 4, the bar clamp 10 further includes an adjustment mechanism 36 for adjusting the transverse separation 30 between the elongated bars 14 and compressing the workpiece 12 along the transverse axis 28. In this embodiment, the length of each of the fixed and movable connectors 24 and 26 is selected so that the transverse separation 30 between the two elongated bars 14 may be adjusted over a range that allows for the clamping or joining of wood parts 20 having thicknesses extending at least between ¾ and 5½ inches. In this regard, it will be appreciated that in some embodiments of the bar clamp 10, the thickness range of wood parts that can be joined into a workpiece 12 represents a significant improvement over what can be commonly achieved with existing bar clamps.

In the embodiment of FIGS. 1 to 2B, the adjustment mechanism 36 is embodied by two adjusting screws 38. Each adjusting screw 38 is configured for engagement into a threaded hole 40 defined into one of the elongated bars 14 and aligned with the one of the transverse holes 22 destined to receive the fixed connector 24. It will be understood that in the illustrated embodiment, the screw axis of the each adjusting screw 38 is preferably perpendicular to both the transverse axis 28 and the longitudinal axis 16. It will also be understood that the transverse separation 30 between the elongated bars 14 may therefore be adjusted and set to a desired value by inserting the fixed connector 24 into one of the transverse holes 22 of each of the elongated bar 14 and tightening the two adjusting screws 38 once the distance between the elongated bars corresponds to the desired transverse separation 30. Compressive action of the adjusting screws 38 against the fixed connector 24 frictionally maintains the desired transverse separation 30 between the elongated bars 14. Releasing the compressive action of the adjusting screws allows adjustments of the transverse separation 30. The adjusting screws 38 may be made of stainless steel, another ferrous material, or any other appropriate material.

In some embodiments, the adjusting screws 38 may also advantageously include a grip knob 42 for facilitating positioning the workpiece on the bar clamp 10 and tightening and loosening of the adjusting screws 38. One of ordinary skill in the art will understand that, in other embodiments, the grip knob 42 may be embodied instead by a grasping device, a stopper protrusion or any other mechanical component or combination of components capable of positioning the workpiece in the bar clamp 10, and of tightening and loosening the adjusting screws 38. It will also be understood that, in other embodiments, the adjustment mechanism 36 may alternatively or additionally be provided on the movable connector 26. Similarly, the adjustment mechanism 36 may be embodied by other fastening means such as bolts or nuts.

Advantageously, in embodiments of the present invention, applying a transverse compressive force to the workpiece 12 over the whole width 34 thereof contributes to stabilizing the wood parts 20 to be joined and to reducing deformations that may occur during the drying process of the adhesives used to edge-glue the wood parts 20 together.

Referring to FIGS. 1 to 4, the bar clamp 10 also includes a positioning mechanism 44 which, in the illustrated embodiment and as described above, includes a plurality of spaced-apart transverse holes 22 defined in and arranged longitudinally along each of the elongated bars 14. The positioning mechanism 44 allows for the adjustment of a position of the movable connector 26 along the longitudinal axis 16 of each elongated bar 14 by changing which of the transverse holes receives the movable connector 26. In other words, the positioning mechanism 44 can allow for an adjustment of the longitudinal separation 32 between the fixed connector 24 and the movable connector 26.

Figure 5:
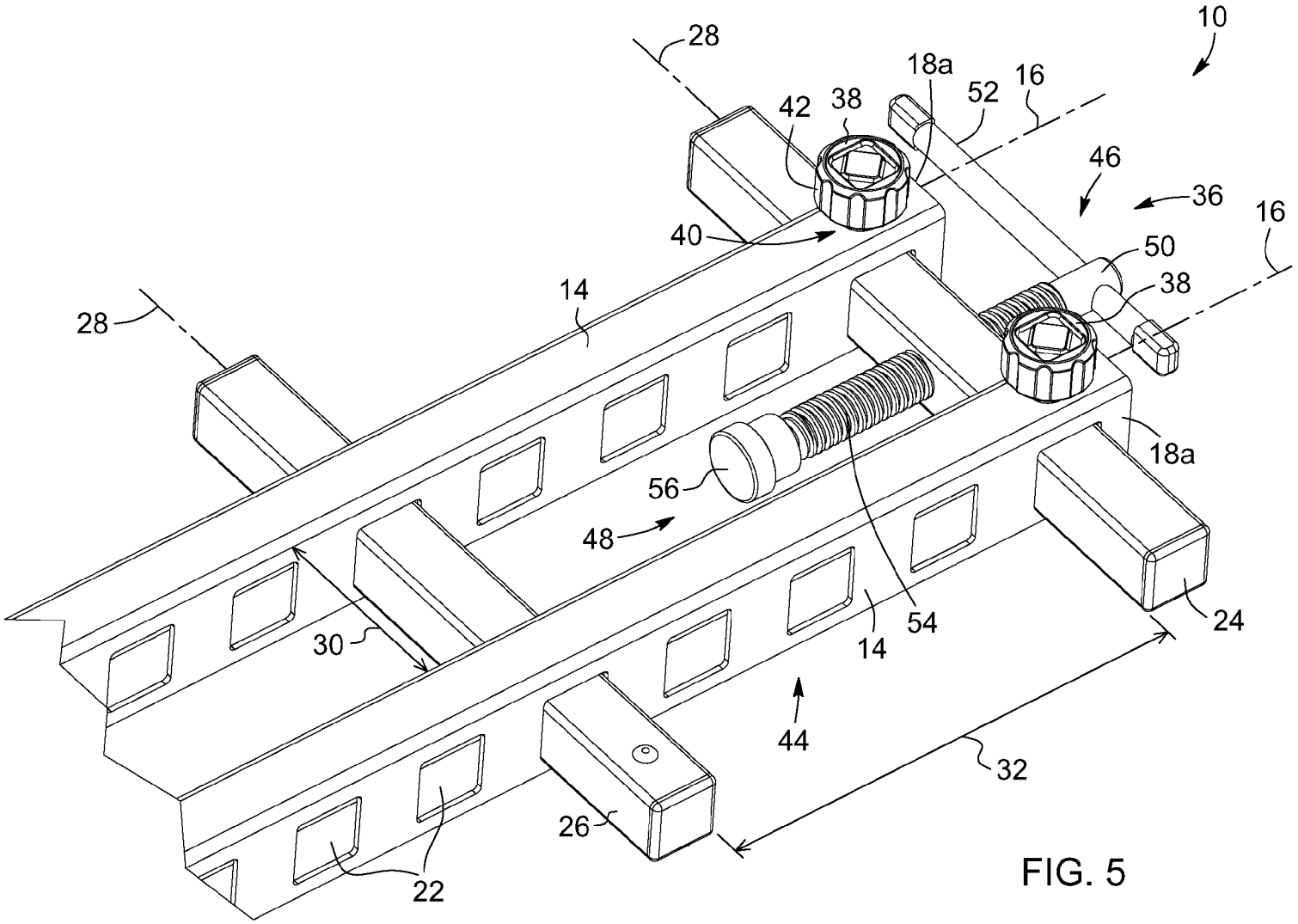
FIG. 5 is a perspective side view of a longitudinal compression mechanism according to another embodiment of the present invention.

The bar clamp 10 further includes a longitudinal compression mechanism 46 connected to the fixed connector 24 and operable to compress the workpiece 12 along the longitudinal axis 16 of each elongated bar 14. In the embodiments shown in FIGS. 1 to 4, the longitudinal compression mechanism 46 includes a longitudinal compression screw 48 which passes through and threadably engages the fixed connector 24, for example via internal threaded holes provided in the fixed connector 24. The compression screw 48 has a head 50 to which is pivotally attached a handle 52, an elongated threaded shaft 54 extending parallelly to the longitudinal axis 16 of each elongated bar 14, and an end portion 56 pressing against the workpiece 12 as the handle 52 is rotated. In an alternate embodiment shown in FIG. 5, the longitudinal compression mechanism 46 includes a compression screw 48 having a head 50 defining a through-hole into which is inserted the handle 52. The handle 52 and the elongated threaded shaft 54 of the screw 48 may be made of stainless steel, another ferrous material, or any other appropriate material. Likewise, the end portion 56 of the compression screw 48 which establishes contact with the edge of the workpiece 12 is preferably made of a plastic or rubber material.

The screw thread of the elongated threaded shaft 54 may preferably have a pitch of less than 6 mm so as to allow better control of the longitudinal compressive force applied by the compression screw 48 on the workpiece. For example, in the embodiment shown in FIGS. 1 to 4, the threaded shaft has a preferred diameter of 0.5 inch, based on an ACME lead screw with 10 threads per inch. However, it will be understood by one of ordinary skill in the art that embodiments of the present invention are not limited by the pitch of the screw thread of the elongated threaded shaft 54. Further preferably, the diameter of the compression screw 48 may be adjusted depending on the thickness of the wood parts 20 to be joined by the bar clamp 10.

Referring more specifically to FIG. 4, it may be seen that upon compressing the workpiece 12 along the longitudinal axis 16 by rotating the handle 52 so as to engage the screw 54 through the fixed connector 24, the workpiece 12 abuts and presses against a side of the movable connector 26. Hence, in preferred embodiments, it may be desirable that the surface of the side of the movable connector 26 in contact with the edge of the workpiece during longitudinal compression thereof provide a large contact area in order to mitigate the risk of marking, scratching or otherwise damaging the edge of the final workpiece 12.

In accordance with another aspect of the invention and referring more specifically to FIGS. 3 and 4, there is provided a bar clamp assembly 100 for engagement with a workpiece 12. The bar clamp assembly 100 includes a plurality of spaced-apart bar clamps 10 which could, by way of example, be embodied by the bar clamp described above and illustrated in FIGS. 1, 2A, 2B and 5. The plurality of spaced-apart bar clamps 10 shown FIGS. 3 and 4 are configured for receiving therebetween the workpiece 12. In the illustrated embodiment, the bar clamp assembly 100 includes two bar clamps 10 for receiving and supporting the workpiece 12 at opposite ends 58*a*, 58*b* thereof. The workpiece 12 includes a plurality of wood parts 20 to be edge-glued together using the compressive forces discussed above and provided by the bar clamps 10 of the bar clamp assembly 100.

It will be understood that in other embodiments, more than two bar clamps 10 may be provided the bar clamp assembly 100 without departing from the scope of the present invention.

While this invention has been particularly shown and described with references to preferred embodiments thereof, it will be understood by one of ordinary skill in the art that various changes in form and details may be made therein without departing from the scope of the invention encompassed by the appended claims.

The invention claimed is:

1. A bar clamp configured for engagement with a workpiece, the bar clamp comprising:

a pair of parallel elongated bars, each elongated bar extending along a longitudinal axis between a first and a second end thereof;

a fixed connector and a movable connector for connecting the pair of elongated bars together, each of the fixed and movable connectors extending between the elongated bars along a transverse axis perpendicular to the longitudinal axes of the elongated bars, and maintaining a transverse separation between the elongated bars;

an adjustment mechanism for adjusting the transverse separation between the elongated bars and compressing the workpiece along the transverse axis, the adjustment mechanism comprising a pair of adjusting screws, each adjusting screw being threadably engageable into a corresponding one of the elongated bars along a screw axis perpendicular to both the longitudinal and the transverse axes, and being configured, upon tightening thereof, to compressively engage against one of the fixed connector and the movable connector;

a positioning mechanism for adjusting a position of the movable connector along the longitudinal axes of the elongated bars; and a longitudinal compression mechanism connected to the fixed connector and operable to compress the workpiece along the longitudinal axes of the elongated bars.

2. The bar clamp according to claim 1, wherein each elongated bar is made of a material comprising one of aluminum, steel, stainless steel, titanium and plastics.

3. The bar clamp according to claim 1, wherein the positioning mechanism comprises a plurality of spaced-apart transverse holes defined in and arranged longitudinally along each elongated bar.

4. The bar clamp according to claim 3, wherein the fixed connector and the movable connector are respectively embodied by a fixed and a movable side bar, each having a first end configured for slidable insertion into one of the plurality of spaced-apart transverse holes of the positioning mechanism defined in one of the elongated bars, and a second end configured for slidable insertion into one of the plurality of spaced-apart transverse holes of the positioning mechanism defined in the other one of the elongated bars.

5. The bar clamp according to claim 1, wherein the longitudinal compression mechanism comprises a longitudinal compression screw, the longitudinal compression screw passing through and threadably engaging the fixed connector, the longitudinal compression screw comprising a head having a handle connected thereto, an elongated threaded shaft, and an end portion configured for pressing against the workpiece as the longitudinal compression screw is tightened via rotation of the handle.

6. The bar clamp according to claim 5, wherein the head is pivotally connected to the handle.

7. A bar clamp assembly for engagement with a workpiece, the bar clamp assembly comprising a plurality of spaced-apart bar clamps configured for receiving therebetween the workpiece, each of the plurality of bar clamps comprising:

a pair of parallel elongated bars, each elongated bar extending along a longitudinal axis between a first and a second end thereof;

a fixed connector and a movable connector for connecting the pair of elongated bars together, each of the fixed and movable connectors extending between the elongated bars along a transverse axis perpendicular to the longitudinal axes of the elongated bars, and maintaining a transverse separation between the elongated bars;

an adjustment mechanism for adjusting the transverse separation between the elongated bars and compressing the workpiece along the transverse axis, the adjustment mechanism comprising a pair of adjusting screws, each adjusting screw being threadably engageable into a corresponding one of the elongated bars along a screw axis perpendicular to both the longitudinal and the transverse axes, and being configured, upon tightening thereof, to compressively engage against one of the fixed connector and the movable connector;

a positioning mechanism for adjusting a position of the movable connector along the longitudinal axes of the elongated bars; and a longitudinal compression mechanism connected to the fixed connector and operable to compress the workpiece along the longitudinal axes of the elongated bars.

8. The bar clamp assembly according to claim 7, wherein the plurality of bar clamps comprises two bar clamps configured for receiving therebetween the workpiece.

* * * * *